United States Patent [19]

Seese et al.

[11] 4,055,025

[45] Oct. 25, 1977

[54] APPARATUS FOR IMPROVED CLEANING OF PIPELINE INLETS

[75] Inventors: Ray Bruce Seese, Conroe; Bela Lee Watson, San Leon, both of Tex.

[73] Assignee: Union Carbide Corporation, New York, N.Y.

[21] Appl. No.: 743,601

[22] Filed: Nov. 22, 1976

[51] Int. Cl.[2] ..... B24C 3/04; B24C 5/00

[52] U.S. Cl. ..... 51/411; 15/3.5; 51/439

[58] Field of Search ..... 15/3.5, 3.51, 3.52, 15/104.05; 51/8 HI, 11; 239/312, 314; 134/22 C, 166 C

[56] References Cited

U.S. PATENT DOCUMENTS

| | | | |
|---|---|---|---|
| 373,926 | 11/1887 | Currier | 51/8 H |
| 992,144 | 5/1911 | Babcock | 51/11 X |
| 1,512,140 | 10/1924 | Schaub | 51/11 |
| 1,848,122 | 3/1932 | Forster | 51/11 |
| 2,440,334 | 4/1948 | Gerlach | 51/11 |
| 3,073,687 | 1/1963 | McCune | 51/8 H X |
| 3,109,262 | 11/1963 | Weaver | 51/8 H |
| 3,285,521 | 11/1966 | Coakley | 239/312 X |

*Primary Examiner*—Gary L. Smith
*Attorney, Agent, or Firm*—Dominic J. Terminello

[57] ABSTRACT

Apparatus including a tubular outer member having a baffle plate positioned therein downstream from the point of injection of gas into said tubular outer member. The baffle plate contains vanes for directing gas spirally to the inner walls of the pipeline to be cleaned. Abrasive material, usually sand, is introduced into the device through a line passing through the center of the baffle plate secured thereto so that the line and the baffle plate may be removed from the tubular outer member as a unit.

3 Claims, 5 Drawing Figures

APPARATUS FOR IMPROVED CLEANING OF PIPELINE INLETS

This invention relates to a process for cleaning pipelines using an abrasive-laden gas stream as the cleaning medium. More particularly the invention relates to apparatus for improving the cleaning efficiency of such a process at the inlet end of pipelines.

It is well known in the prior art that pipelines may be cleaned using an abrasive-laden gas stream. A typical process is described in U.S. Pat. No. 3,073,687 issued Jan. 15, 1963. As taught in such U.S. patent suitable inlet and outlet velocities for the gas stream may vary according to the diameter of the pipeline being cleaned. However, outlet velocity should not be too great so as to cut away too much of the metal of the outlet end of the pipe, while inlet velocities should be great enough to carry the abrasive through the pipe in an agitated turbulent condition. Because of the upper limit in exit velocity the ratio of the discharge pressure ($P_2$) to inlet pressure ($P_1$) can be determined, since the discharge pressure is atmospheric, to $P_1 > P_2$. Because velocity is inversely proportional to pressure, velocity of the inlet ($V_1$) is less than the velocity of the outlet ($V_2$) or $V_2 > V_1$.

It is this decreased velocity of the propellant gas and the entrained abrasive material that has contributed to the reduced cleaning that was observed in the inlet portion of a pipeline during the early stages of development of this cleaning process.

Up until now the use of distinct abrasive runs or charges in the cleaning of the pipeline is one of the methods used to minimize this problem. At the start of a run, the pressure of the inlet to the pipeline increases from atmospheric to $P_1$, over a period of a few minutes. Low propellant density corresponding to the lower pressures during this time period results in a high propellant velocity at the inlet. As the run continues, stabilization of the flow begins, the pressure at the inlet increases, the velocity approaches its lower steady-state value and subsequently the amount of cleaning near the inlet decreases. The abrasive charge is stopped; the line is allowed to come to atmospheric pressure after the charge of abrasive has cleared the discharge end of the line. Then another charge is prepared and sent down the line again producing an initial high velocity of the propellant and abrasive in the inlet portion of the pipeline. Runs are continued until the cleaning is as nearly uniform as possible throughout the length of the pipeline.

Some of the original equipment used in this type of process attempted to further increase the cleaning at the inlet through use of a specially designed injection head. The theory of operation of the head was to produce a swirling of the propellant gas to entrain the abrasive material and direct it at a sharp angle at the interior pipe wall. The problem was to transform a portion of the axial velocity and pressure energy of the inlet propellant gas into a tangential velocity component that would improve cleaning on the inlet sections of the pipeline. The higher pressures and corresponding lower velocities that occur in the inlet sections of the pipeline would then be overcome by the more oblique impact of the abrasive material on the interior pipe wall.

In the prior art solution at the expense of inlet axial velocity and inlet static pressure, the propellant and abrasive material is made to flow in a circumferential manner thus forcing the abrasive to strike the wall at a sharper angle in that inlet sections of the line. The purpose is to counteract low inlet velocity. The result is a more uniform cleaning of the entire length of the pipeline.

A design to accomplish the above is shown in FIG. 3 of U.S. Pat. No. 3.073,687. The head was bolted to the pipeline being cleaned. The charge of sand or clay was fed to the pipeline being cleaned. The charge of sand or clay was fed to the pipeline from an abrasive vessel through nozzles. The propellant gas was injected through other nozzles, and was diverted by baffles, just downstream of each nozzle. These baffles along with the conical section, of the head imparted a tangential component to the velocity of the gas on injection into the pipeline, creating a swirl of gas and abrasive.

This design, although it does provide some increase in cleaning at the inlet to a pipeline, does not operate as effeciently as required. Due to the shape and dimensions of the baffles, they do not effectively direct the flow to produce a large enough tangential component on outlet.

In addition, the design of the head was such as to contribute to the length of time required to clean a line. The head had to be unbolted from the pipeline during proof and dust ball runs for insertion of the balls into the pipeline after which the head was rebolted to the pipeline.

Accordingly it is a main object of the invention to provide an injection head for cleaning operations which improves the cleaning action at the inlet end of a pipeline to be cleaned.

Another object is to provide such an injection head which does not have to be removed from the pipeline for proof and dust ball runs.

These and other objects will either be pointed out or becomes apparent from the following description and drawings wherein.

Figure 1:
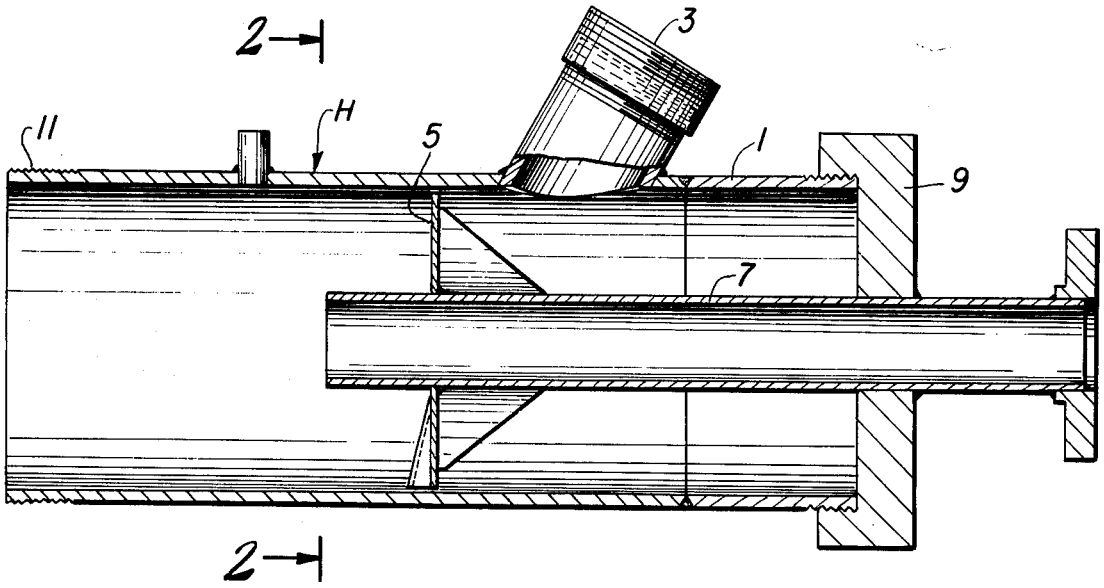
FIG. 1 is cross-sectional view of a preferred injection head of the invention.
Figure 2:
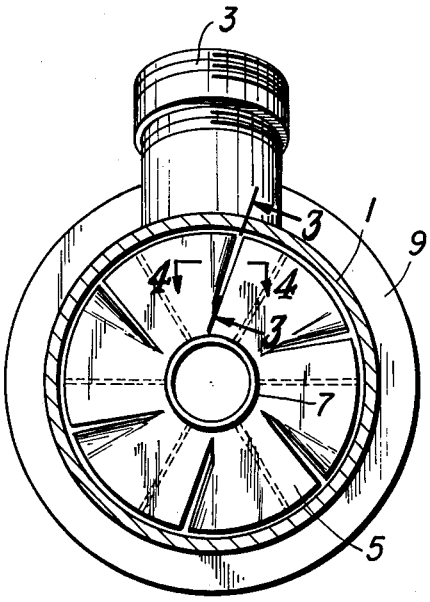
FIG. 2 is a section taken along the line 2—2 in FIG. 1.
Figure 3:
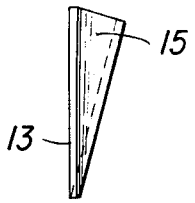
FIG. 3 is a section taken along the line 3—3 in FIG. 2.

Referring now to the drawings, FIG. 1 shows a typical injection head H. The head H consists of a tubular head number 1 having a propellant gas injection port 3 in the outer wall thereof for introducing as into the head radially rather than axially. Typically the gas port 3 is inclined so that its longitudnally axis forms an angle of about 30° with the vertical. A circular baffle plate 5 of essentially the same diameter as the inside diameter (I.D.) of the tubular member 1 is located in the tubular member 1 downstream of the gas port 3. The baffle plate has a central opening through which extends a single abrasive injection line 7. The line 7 extends at its other end through closure member 9. The injection 7 is secured to the baffle plate 5 and the closure member 9 so that these elements can be removed as a unit from the tubular member 1. This feature permits the tubular member 1 to remain secured to a pipeline so that a dust or proof ball may be inserted therethrough without having to unbolt the head H from the pipeline. The downstream end of the head is externally threaded at 11 to allow for adopting the head H to pipelines of different diameters using internally threaded reducers and/or throwded flange fittings.

Figure 4:
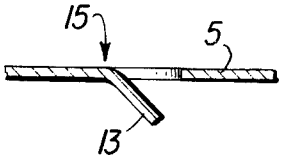
FIG. 4 is a section taken along the line 4—4 in FIG. 2.

The baffle plate 5 has a plurality of vanes formed around the central opening therein. Typically the plate 5 has six vanes spaced 60° apart. The outer edges 13 (see FIG. 4 and 5) of the vanes 15 are bent away from the front face of the plate 5 at an angle of about 45 degrees from the horizontal so as to direct the propellant gas spirally to the pipe wall. The baffle plate containing the vanes 15 has a flow area equivalent to that of the propellant gas wall port 3.

Figure 5:
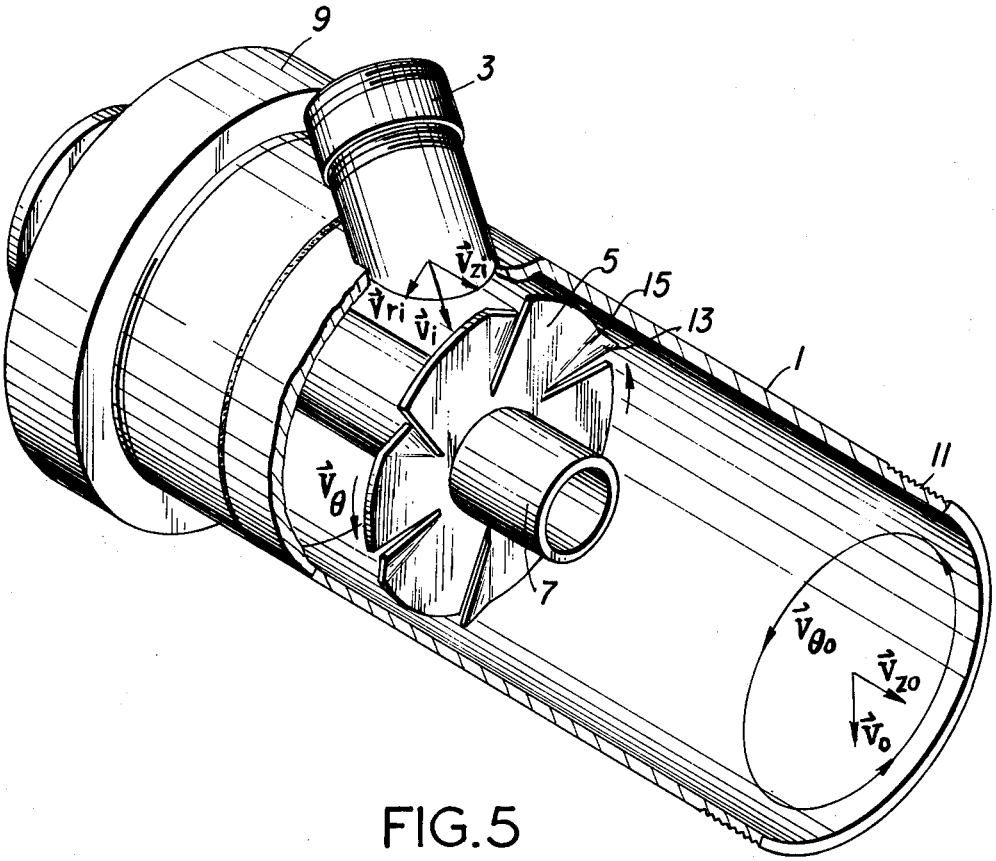
FIG. 5 is a schematic drawing in perspective of the device of the invention showing velocity vectors of the injected carrier gas.

FIG. 5 is a sketch of the injection head showing the propellant gas inlet and outlet velocity vectors. The velocity vector on inlet $\vec{V}_i$ is formed from a radial, $\vec{V}_{ri}$ and an axial, $\vec{V}_{zi}$, component due to the position of the gas propellant port 3, at 30° from the vertical. The propellant gas acquires a large tangential velocity as it approaches and passes through the baffle 5.

The injection head outlet velocity vector $\vec{V}_e$ is therefore the sum of a relatively large tangential component. $\vec{V}_{\Theta o}$, and an axial component $\vec{V}_{zo}$. $\vec{V}_{zo}$ is the axial component of the pipeline inlet velocity.

The effect of the injection head is to superimpose on the axial flow of the propellant, a subsidiary tangential motion which promotes mixing of the propellant and abrasive and causes impact at a sharper angle of the abrasive upon the interior pipe wall. The cleaning done at the beginning of the line with a low axial velocity, $V_{zb}$ and a tangential component $V_{\ i}$ is equivalent to that done at the end of the line with a large purely axial velocity.

Accordingly it will be obvious that the injection head of this invention provides for a single easy way to improve cleaning of the inlet end of a pipeline.

While the invention has been described with reference to a typical preferred embodiment, it should be understood that certain minor modifications can be made to the apparatus or the arrangement of part thereof without departing from the spirit and scope of the invention.

We claim:

1. An injection head for introducing an abrasive ladened gas stream into a pipeline to be cleaned so as to improve the cleaning at the inlet of such pipeline comprising; a tubular head member having an inlet end and an outlet end and adapted at its outlet end to be secured to the inlet end of the pipeline to be cleaned; a gas inlet provided in the outer wall of said head member for introducing gas into said head in a radial direction so as to impact a swirling action to the gas; a quick connect closure member at the inlet end of said head member; a circular baffle plate of essentially the same diameter as the I.D. of the head member located in said head member downstream of the point of introduction of gas into said head member, said baffle plate being provided with a central opening surrounded by a plurality of vanes formed for directing gas passing through said vanes spirally to the head member walls and having a flow area equivalent to the flow area of the gas inlet; a single abrasive injection line passing through said closure member and said central opening in said baffle plate and exending beyond the baffle plate so that abrasive material is introduced into the head member downstream of said baffle plate, said injection line being secured to the baffle plate and the closure member so that the injection line and baffle plate may be removed as a unit with said closure member.

2. An injection head according to claim 1 wherein said baffle plate contains six vanes spaced about 60° apart.

3. An injection head according to claim 1 wherein said vanes are formed so that the outer edges are bent away from the front face of the baffle plate at an angle of about 45°.

* * * * *